US011802698B2

(12) United States Patent
Stevenson

(10) Patent No.: US 11,802,698 B2
(45) Date of Patent: Oct. 31, 2023

(54) SYSTEMS AND METHODS FOR CONTROLLING AND ADJUSTING VOLUME OF FRESH AIR INTAKE IN A BUILDING STRUCTURE

(71) Applicant: QC Manufacturing, Inc., Temecula, CA (US)

(72) Inventor: Dana Charles Stevenson, Canyon Lake, CA (US)

(73) Assignee: QC MANUFACTURING, INC., Temecula, CA (US)

( * ) Notice: Subject to any disclaimer, the term of this patent is extended or adjusted under 35 U.S.C. 154(b) by 0 days.

(21) Appl. No.: 17/654,567

(22) Filed: Mar. 11, 2022

(65) Prior Publication Data

US 2022/0196265 A1 Jun. 23, 2022

Related U.S. Application Data

(63) Continuation of application No. 16/579,189, filed on Sep. 23, 2019, now Pat. No. 11,274,839.

(60) Provisional application No. 62/734,729, filed on Sep. 21, 2018.

(51) Int. Cl.

| | |
|---|---|
| ***F24F 7/007*** | (2006.01) |
| ***F24F 7/06*** | (2006.01) |
| ***F24F 13/10*** | (2006.01) |
| *F24F 110/40* | (2018.01) |
| *F24F 7/00* | (2021.01) |

(52) U.S. Cl.

CPC ..... *F24F 7/065* (2013.01); *F24F 13/10* (2013.01); *F24F 2007/001* (2013.01); *F24F 2110/40* (2018.01)

(58) Field of Classification Search

CPC .... F24F 7/065; F24F 7/06; F24F 13/10; F24F 13/14; F24F 13/1413; F24F 13/142; F24F 2013/146; F24F 2110/40

USPC ..... 454/238, 253, 251, 259, 333–336, 454/275–277

See application file for complete search history.

(56) References Cited

U.S. PATENT DOCUMENTS 4,794,852 A * 1/1989 Ee ..... F24F 13/1413 454/271

5,195,927 A * 3/1993 Raisanen ..... F24F 13/1426 454/271

(Continued)

*Primary Examiner* — Ko-Wei Lin

(74) *Attorney, Agent, or Firm* — Knobbe, Martens, Olson & Bear LLP

(57) ABSTRACT

A fresh-air cooling system and methods of cooling a building structure with the same are provided. The system has an exterior interface assembly, a damper, a register, a duct, and a motorized fan. The exterior interface assembly is connected to the register by the duct and provides a flow path for air outside the building to enter the duct. The motorized fan is disposed in an attic of the building structure and pulls air into the attic from a living space to create a negative static pressure in the living space. The damper is positioned along the flow path from the exterior interface assembly to the living space and opens to allow air outside the building structure to enter the living space in response to motorized fan creating in the living space a negative static pressure that exceeds the cracking pressure of the damper. The cracking pressure of the damper can be adjusted to control the flow rate of outside air through the damper.

28 Claims, 10 Drawing Sheets

(56) References Cited

U.S. PATENT DOCUMENTS 6,203,423 B1 * 3/2001 Craw ..... F24F 13/1486 454/259
6,386,828 B1 * 5/2002 Davis ..... F24F 7/013 416/223 R
7,497,774 B2 * 3/2009 Stevenson ..... F24F 13/0218 454/341
8,079,898 B1 * 12/2011 Stevenson ..... F24F 13/0218 55/306
8,888,574 B2 * 11/2014 Bredahl ..... F24F 13/1413 454/339
10,550,952 B1 * 2/2020 Ficner ..... F16K 31/042
11,274,839 B1 3/2022 Stevenson
2006/0035581 A1 * 2/2006 Stevenson ..... F24F 13/0218 454/353
2009/0186572 A1 * 7/2009 Farrell ..... F24F 11/30 454/333
2010/0178863 A1 * 7/2010 Coward ..... F24F 11/75 454/333
2011/0053488 A1 * 3/2011 Gans ..... F23L 17/005 454/343
2011/0097990 A1 * 4/2011 Charron ..... D06F 58/20 454/367
2012/0083196 A1 * 4/2012 Mockridge ..... H05K 7/20745 454/239
2012/0289139 A1 * 11/2012 Fujimura ..... F24F 11/74 454/238
2013/0045671 A1 * 2/2013 Apple ..... F24F 11/0001 454/239
2013/0324029 A1 * 12/2013 Sandman ..... F24F 13/0209 454/333
2014/0170961 A1 * 6/2014 Labrecque ..... F24F 7/10 454/259
2015/0204568 A1 * 7/2015 Thomas ..... F24F 11/52 62/127
2016/0265806 A1 * 9/2016 Chappell ..... F24F 13/1426
2017/0205107 A1 * 7/2017 Williams ..... F24F 11/72
2018/0216845 A1 * 8/2018 Whitehead ..... F24F 13/14
2018/0259205 A1 * 9/2018 Coogan ..... B08B 15/023
2018/0274810 A1 * 9/2018 Woods ..... F24F 11/79
2018/0372364 A1 * 12/2018 Elwell ..... F21V 33/0092
2019/0017724 A1 * 1/2019 Sekar ..... F24F 13/1426
2019/0056141 A1 * 2/2019 Carey ..... F24F 13/1486
2019/0137126 A1 * 5/2019 Desrochers ..... F24F 11/0001
2019/0203971 A1 * 7/2019 Iio ..... F24F 11/0001
2020/0240674 A1 * 7/2020 Howe ..... F16K 1/222

* cited by examiner

SYSTEMS AND METHODS FOR CONTROLLING AND ADJUSTING VOLUME OF FRESH AIR INTAKE IN A BUILDING STRUCTURE

INCORPORATION BY REFERENCE TO ANY PRIORITY APPLICATIONS

Any and all applications for which a foreign or domestic priority claim is identified in the Application Data Sheet as filed with the present application are incorporated by reference under 37 CFR 1.57 and made a part of this specification.

BACKGROUND

Field

Certain embodiments discussed herein relate to methods and systems of regulating airflow in a building structure.

Description of the Related Art

Fans, air conditioners, and other ventilation systems have been developed for residential and commercial building structures. While air conditioners are capable of lowering the temperature of the ambient air, they are not energy efficient or environmentally friendly. In addition, air conditioners typically do not bring in enough fresh air from outside for those who prefer fresh outdoor air.

Whole house fans provide energy-efficient and environmentally-friendly cooling systems with substantial fresh air intake. However, doors or windows must be left ajar when the whole house fan is operating, thus creating a security risk for some. In addition, whole house fans require a user to open or close doors and windows depending on whether the fan is running or stopped, making the system unsuitable for changing the mode of operation of the system when the user is not home.

Ventilation fans can bring outside fresh air into a building structure without requiring opening windows and doors. However, ventilation fans bring a fixed amount of fresh air into a structure based on the flow capacity (e.g. cubic feet per minute (CFM)) of the fan. There is not a way to control the volume of fresh air intake from a ventilation fan in the same way one can by opening windows or doors.

A need exists for secure, convenient, and effective systems and methods for controlling and adjusting fresh air intake without requiring opening windows or doors.

SUMMARY

Disclosed herein are embodiments of a fresh-air cooling system and methods of cooling a building structure with the fresh-air cooling system. In some aspects, the fresh-air cooling system includes an exterior interface assembly, a damper, a register, a duct, and a motorized fan. The exterior interface assembly comprises a face portion and a conduit. The face portion is configured to attach to an exterior surface of an exterior wall of the building structure. The conduit is sized to extend from the face portion through at least a portion of the exterior wall. The damper is disposed within the conduit and comprises a moveable flap and a biasing element. The biasing element is configured to bias the moveable flap toward a closed configuration that blocks entirely an internal cross-sectional area of the conduit with the moveable flap such that an airflow through the conduit is prevented. The biasing element is further configured to allow the moveable flap to move to an open configuration in response to a cracking pressure being applied across the damper, wherein in the open configuration at least a portion of the internal cross-sectional area of the conduit is uncovered by the moveable flap such that the airflow through the conduit is allowed. The register is configured to be disposed on an interior wall or ceiling of the living space. The register comprises a grill and an antechamber. The grill is configured to attach to an interior surface of the interior wall or ceiling of the living space. The antechamber is configured to house a filter that is disposed between the grill and the antechamber. The duct is configured to provide a flow path from the conduit to the antechamber. The motorized fan is configured to be disposed in the attic and pull air from the living space into the attic at an airflow rate that is sufficient to create in the living space a negative static pressure that exceeds the cracking pressure of the damper such that the damper moves to an open configuration that allows air outside of the building to flow into the living space.

In some aspects, an automated air intake assembly is provided. The automated air intake assembly includes an exterior interface assembly, a register, a duct, a damper, and a damper tuning system. The duct provides a flow path between the exterior interface assembly and the register. The damper is disposed within the duct, the register, or the exterior interface assembly. The damper is configured to move between an open configuration and a closed configuration, wherein the damper being in the open configuration allows an airflow to move along the flow path in a direction from the exterior interface assembly to the register, and wherein the damper in the closed configuration blocks the airflow along the flow path. The damper is further configured to move from the closed configuration to the open configuration in response to a pressure across the damper exceeding a cracking pressure of the damper. The damper tuning system is configured to allow the cracking pressure of the damper to be changed.

In some aspects, a method of cooling a building having an attic and a living space is provided. The method includes energizing a motorized fan disposed in the attic to move air from the living space into the attic, thereby creating a negative static pressure in the living space, the negative static pressure being less than an ambient air pressure of air outside of the building. The method further includes moving a first damper disposed inside a first air intake assembly from a closed configuration to an open configuration in response to the negative static pressure exceeding a first cracking pressure of the first damper, wherein the open configuration allows the air outside of the building to flow through the first air intake assembly to reach the living space. The method further includes moving a second damper disposed inside a second air intake assembly from a closed configuration to an open configuration in response to the negative static pressure exceeding a second cracking pressure of the second damper, wherein the open configuration allows the air outside of the building to flow through the second air intake assembly to reach the living space. The second cracking pressure is less than the first cracking pressure.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Embodiments of systems, components, and methods of assembly and manufacture will now be described with reference to the accompanying figures, wherein like numerals refer to like or similar elements throughout. Although several embodiments, examples, and illustrations are disclosed below, it will be understood by those of ordinary skill in the art that the inventions described herein extend beyond the specifically disclosed embodiments, examples, and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Fresh-air cooling systems can create a negative pressure within a living space of a building structure by moving a large volume of air quickly out of the living space. The negative pressure within the living space draws outside air into the living space. Traditional fresh-air cooling systems rely on open windows and doors to provide the air inflow pathways that support the high-volumetric flow rate of air removal by the cooling system. Fresh-air cooling systems that have inadequate air inflow pathways can result in inefficient cooling and back drafting of vented appliances (e.g., water heaters, kitchen hoods).

A problem with relying on windows and doors as air intakes for the fresh-air cooling system is that the outside air can only enter the building at the periphery of the building, making cooling less effective for the inner rooms or rooms that do not have a window or door communicating with the outside environment. Opening windows and doors to operate the fresh-air cooling system is also not convenient in that a person must be present to open the windows and doors. Open windows and doors can present a security risk that may make users uneasy about running the system, especially during night or early morning, which can be ideal times for using the fresh-air cooling system. The cooling systems and air intake assemblies of the present disclosure provide secure, convenient, and versatile ways to regulate the flow of air in a fresh-air cooling system.

Figure 1:
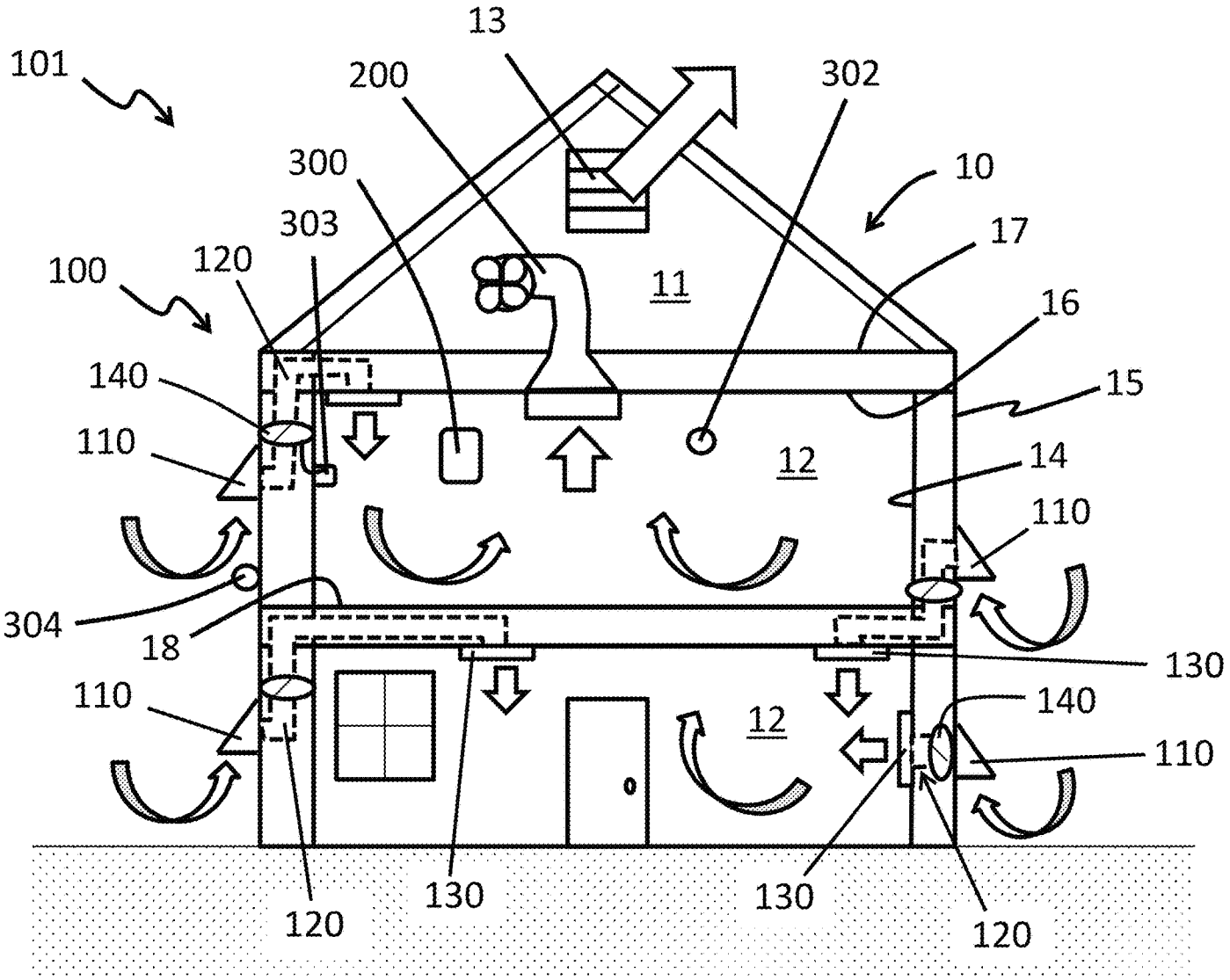
FIG. 1 is a schematic diagram of a cooling system that includes an air intake assembly according to some aspects of the present disclosure.

FIG. 1 depicts an illustrative, non-limiting embodiment of an adjustable air intake assembly 100 of a fresh-air cooling system 101 of the present disclosure. As discussed herein, the air intake assembly 100 can provide a safe and automated way to provide a controlled and adjustable flow pathway for the fresh-air cooling system to draw outside air into the living space 12 without opening any windows or doors. In the illustrated embodiment, the fresh-air cooling system 101 includes four adjustable air intake assemblies 100: one air intake assembly 100 is shown conveying outside air to an upper floor (e.g., second floor) of the living space 12 of the building structure 10; the other three air intake assemblies 100 are shown conveying outside air to a ground floor (e.g., first floor) of the living space 12. As shown in FIG. 1, a plurality of adjustable air intake assemblies 100 can be used in conjunction with one another in the fresh-air cooling system 101. In some embodiments, a single adjustable air intake assembly 100 can be used alone in the fresh-air cooling system 101. The fresh-air cooling system 101 can be configured to automatically open and close the air intake assembly 100 based on user preference, as described herein.

With continued reference to FIG. 1, the air intake assembly 100 can include an exterior interface assembly 110, a duct 120, a register 130, and a damper 140. The exterior interface assembly 110 can be disposed in an opening on an exterior of the building structure 10. The register 130 can be disposed on an interior of the building structure 10. The duct 120 can provide a flow path between the exterior interface assembly 110 and the register 130. The damper 140 can regulate air flow through the air intake assembly 100. In the illustrated embodiment, the damper 140 is shown as disposed within the duct 120. In some embodiments, the damper 140 can be disposed at a location other than within the duct 120, as discussed herein. The damper 140 can be configured to control or adjust the volume of fresh air that is drawn through the adjustable air intake assembly 100, as described herein.

The adjustable air intake assembly 100 can have an open configuration that allows outside air to enter the building structure 10. The air intake assembly can have a closed configuration that minimizes or blocks the flow of outside air into the building structure 10. The air intake assembly 100 can be adjustable to allow control or adjustment of the volume of fresh air that is drawn into the building structure through the air intake assembly 100. For example, the adjustable air intake assembly 100 can be adjusted between a fully-opened configuration that provides a maximum volumetric flow rate of fresh outside air through the air intake assembly 100 and a partially-opened configuration that provides a volumetric flow rate of fresh outside air through the air intake assembly 100 that is less than the maximum flow rate achieved when the air intake assembly 100 is in the fully-open configuration. In some aspects, the adjustable air intake assembly 100 can be adjusted to increase the volumetric flow of outside air through the air intake assembly 100 according to user preference (e.g., to make an interior room more breezy). In some aspects, the adjustable air intake assembly 100 can be adjusted to decrease the volumetric flow of outside air through the air intake assembly 100 while maintaining a flow of outside air through the air intake assembly 100. In some embodiments, the air intake assembly 100 can be adapted to minimize or block air flow out from the living space 12 to the outside environment when the air intake assembly 100 is in the closed configuration. In some aspects, the air intake assembly 100 can move between the open and closed configurations automatically, allowing the air intake assembly 100 to regulate the operation of a fresh-air cooling system 101 in the absence of user intervention.

In some aspects, the cooling system 101 can include an integrated thermostat 300 that controls operation of the air intake assembly 100. For example, the integrated thermostat 300 can be connected to the air intake assembly 100 through a wired or wireless connection. The integrated thermostat 300 can send a control signal to the air intake assembly 100 through the wired or wireless connection to switch the air intake assembly 100 between the open (e.g. fully-opened or partially-opened) and closed configurations. In some embodiments, the control signal from the integrated thermostat 300 can move the damper 140 between a closed configuration and an open (e.g., fully-opened, partially-opened) configuration, as discussed herein. The integrated thermostat 300 can be connected to an internal temperature sensor 302 disposed within the building structure 10. The integrated thermostat 300 can be connected to an external temperature sensor 304 disposed on the outside of the building structure 10. In some aspects, the integrated thermostat 300 can open and close the air intake assembly 100 based on the temperature readings provided by the internal temperatures sensor 302 and the external temperature sensor 304.

FIG. 1 depicts the fresh-air cooling system 101 operating to cool the building structure 10. The direction of air flow through the building is shown as open arrows in FIG. 1. The building structure 10 can include ductwork or staircases (not shown) that provide flow paths for air to move from one area of the living space 12 (e.g., a lower level of the living space 12) to another area of the living space 12 (e.g., an upper level of the living space 12). As indicated in FIG. 1, the air intake assembly 100 can have an open configuration that allows outside air to enter the building structure 10 through the air intake assembly 100. Outside air can enter the air intake assembly 100 through the exterior interface assembly 110, flow from the exterior interface assembly 110 to the register 130 through the duct 120, and exit the register 130 to enter the living space 12. The damper 140 can be adapted to regulate air flow through the duct 120. The damper 140 can allow air flow through the duct 120 in a direction from the exterior interface assembly 110 to the register 130 when the damper 140 is in the open configuration. The damper 140 can minimize or block the flow of air through the duct 120 when the damper 140 is in the closed configuration. In some arrangements, the damper 140 can be disposed at a location other than within the duct 120 (e.g. within the exterior interface assembly 110 or within the register 130).

As shown in FIG. 1, the fresh-air cooling systems 101 can include a high-capacity fan 200 that can rapidly draw a large volume of air out of the living space 12. The damper 140 can be adapted to move automatically from the closed configuration to the open configuration when the high-capacity fan 200 is operating. The damper 140 can be adapted to move automatically from the open configuration to the closed configuration when the high-capacity fan 200 stops operating. The air intake assembly 100 can move between the open and closed configuration in response to a control signal received from the integrated thermostat 300.

In some arrangements, the air intake assembly 100 can move between the open and closed configuration without receiving a control signal from the integrated thermostat 300. For example, the air intake assembly 100 can be adapted to move between the open and closed configurations in response to an air pressure of the living space 12. In some embodiments, the air intake assembly 100 can be adapted so that the air intake assembly moves from the closed configuration to the open configuration once the air pressure in the living space 12 falls below a threshold negative pressure (also referred to herein as "a cracking pressure" or variants thereof). In some aspects, the air intake assembly 100 can open in response to a negative static pressure that is created in the living space 12 by the high-capacity fan 100. The air intake assembly 100 can be adapted to remain in the closed configuration when the air pressure in the living space 12 is above the cracking pressure. In some embodiments, the air intake assembly 100 can have a cracking pressure between: 0.03 mmHg and 6 mmHg; 0.06 mmHg and 3 mmHg; 0.1 mmHg and 2 mmHg; 0.2 mmHg and 1 mmHg; 0.3 mmHg and 0.8 mmHg. In some aspects, the cracking pressure of the air intake assembly 100 can be adjusted to modify the volumetric flow of outside air that flows through the air intake assembly 100 in response to the negative static pressure created in the living space 12 by the high-capacity fan 200. In some aspects, the cracking pressure of the air intake assembly 100 can be set or adjusted before or during installation of the air intake assembly 100 in the building structure 10. In some aspects, the cracking pressure of the air intake assembly 100 can be adjusted or modified after the air intake assembly 100 is installed in the building structure 10. In some embodiments, the air intake assembly 100 can include a control dial 303 configured to adjust the cracking pressure of the air intake assembly 100, as described herein. The control dial 303 can be disposed within the living space 12 and can communicate with the air intake assembly 100 through a mechanical, wired, or wireless pathway to allow a user to adjust the cracking pressure of the air intake assembly 100.

The air intake assembly 100 can provide an inflow pathway for outside air into the living space 12 to support the rapid removal of air from the living space air 12 by the high-capacity fan 200. When the air intake 100 is in the open configuration, the air intake assembly 100 can allow a large volumetric flow rate of outside air to enter the building structure 10. The volumetric flow rate of air through the air intake assembly 100 when the air intake assembly 100 is in the fully-open configuration can also be referred to herein as the "maximum open flow rate" or variants thereof. The air intake assembly 100 can have a maximum open flow rate of about: 1000 cubic feet per minute (CFM), 2000 CFM, 3000 CFM, 4000 CFM, 6000 CFM, 8000 CFM. The maximum open flow rate of the air intake assembly 100 will depend at least in part on the pressure difference across the air intake assembly 100 (e.g., the pressure difference between the living space 12 and the outside environment). The air intake assembly 100 can have a maximum open flow rate between 1000 CFM and 8000 CFM for a pressure difference of 5 mmHg. In some arrangements, the air intake assembly 100 can have a maximum open flow rate between 1000 CFM and 8000 CFM for a pressure difference of 1 mmHg. In some variants, the air intake assembly 100 can have a maximum open flow rate between 1000 CFM and 8000 CFM for a pressure difference of 0.1 mmHg. As described herein, the fresh-air cooling system 101 can include a plurality of air intake assemblies 100. In some aspects, at least some of the plurality of air intake assemblies 100 can have different cracking pressures or flow rates compared to other air intake assemblies 100 of the plurality. In some aspects, the fresh-air cooling system 101 can include two or more air intake assemblies 100 that have the same cracking pressure or flow rate. In some arrangements, the fresh-air cooling system 101 can allow a user to change or adjust the cracking pressure or flow rate of the air intake assembly 100. In some aspects, the fresh-air cooling system 101 can allow a user to change or adjust the cracking pressure of the air intake assembly 100 in order to increase or decrease the flow of outside air through the air intake assembly 100. For example, a user can decrease the cracking pressure of the air intake assembly 100 to increase the flow rate of fresh outside air into the portion (e.g., interior room) of the living space 12 serviced by the air intake assembly 100. In some aspects, a user can increase the cracking pressure of the air intake assembly 100 to decrease the flow rate of fresh air to the portion of the living space 12 that receives air from the air intake assembly 100. In some arrangements, the fresh-air cooling system 101 can include a plurality of adjustable air intake assemblies 100, and a user (or integrated thermostat 300) can adjust the cracking pressures of the air intake assemblies 100 in order to change air flow through the building structure 10. The air intake assemblies 100 can allow a user to adjust the fresh air intake without opening doors or windows of the building structure 10. In some aspects, the cracking pressure of the air intake assemblies 100 can be adjusted or controlled to shift the flow of fresh outside air to a particular portion of the living space 12 (e.g., a bedroom). The fresh-air cooling system 101 can allow the cracking pressures of the air intake assemblies 100 to be adjusted to shift a portion or an entirety of the flow of fresh outside air from a first flow path (e.g., through a living room of the living space 12) to a second flow path (e.g., through a bedroom of the living space 12). In this way, the adjustable air intake assembly 100 can allow a user to control or adjust the volume and pathway of the flow of fresh outside air that is drawn through the living space 12 by the high-capacity fan 200.

As shown in FIG. 1, the duct 120 of the air intake assembly 100 can be installed within a wall space of the building structure 10. The duct 120 can be installed between an interior wall 14 and an exterior wall 15 of the building structure 10. In some arrangements, the duct 120 can be installed between a living space ceiling 16 and an attic floor 17. In some arrangements, the duct 120 can be installed between a living space ceiling 16 of a lower level of the living space 12 and a living space floor 18 of an upper level of the living space 12. FIG. 1 shows that in some embodiments the duct 120 can extend a greater or lesser extent along the living space ceiling 16 in order to position the register 130 further from or closer to the outer periphery of the living space 12. The duct 120 can also extend within the wall space a greater or lesser extent along a vertical wall 14 of the living space 12. In this way, the air intake assembly 100 can be adapted to deliver outside air to any desired location of the living space 12.

Turning again to FIG. 1, the duct 120 can extend upwardly within the wall space of the building structure 10 to connect the exterior interface assembly 110 with a register 130 that is positioned at a height above the exterior interface assembly 110. In some embodiments, the duct 120 can extend downwardly within the wall space of the building structure 10 to connect the exterior interface assembly 110 with a register 130 that is positioned at a height below the exterior interface assembly 110. In some embodiments, the duct 120 can extend substantially horizontally between an exterior wall 15 and an interior wall 14 to connect the exterior interface assembly 110 with a register 130 that is roughly at the same height as the exterior interface assembly 110.

The register 130 can be installed in a living space ceiling 16, an interior wall 14, or a floor 18 of the living space 12. In some embodiments, the air intake assembly 100 can include a manifold or a branch point (e.g. a diverging Y-junction) that allows one exterior interface assembly 110 to be connected to multiple, spaced-apart registers 130. In some embodiments, the air intake assembly 100 can include a manifold or a branch point (e.g. a converging Y-junction) that allows multiple exterior interface assemblies 110 to be connected to a single common register 130. As shown in FIG. 1, the exterior interface assembly 110 of the air intake assembly 100 can be positioned at a height on the exterior of the building structure 10 such as to avoid or minimize outside debris from being sucked into the air intake assembly 100. In some arrangements, the exterior interface assembly 110 is positioned at least 2 feet above the ground to avoid sucking dirt into the exterior interface assembly 110 when the cooling system 101 is drawing air in through the air intake assembly 100. As discussed herein, the exterior interface assembly 110 can include filtering features (e.g., a screen, a flange) that are adapted to avoid or minimize debris from being sucked into the air intake assembly 100. In some arrangements, the exterior interface assembly 100 can be configured to prevent or inhibit rain or wind-borne particulates from entering the building structure 10. In some embodiments, the exterior interface assembly 100 can be a louver (e.g., weather louver).

Figure 2:
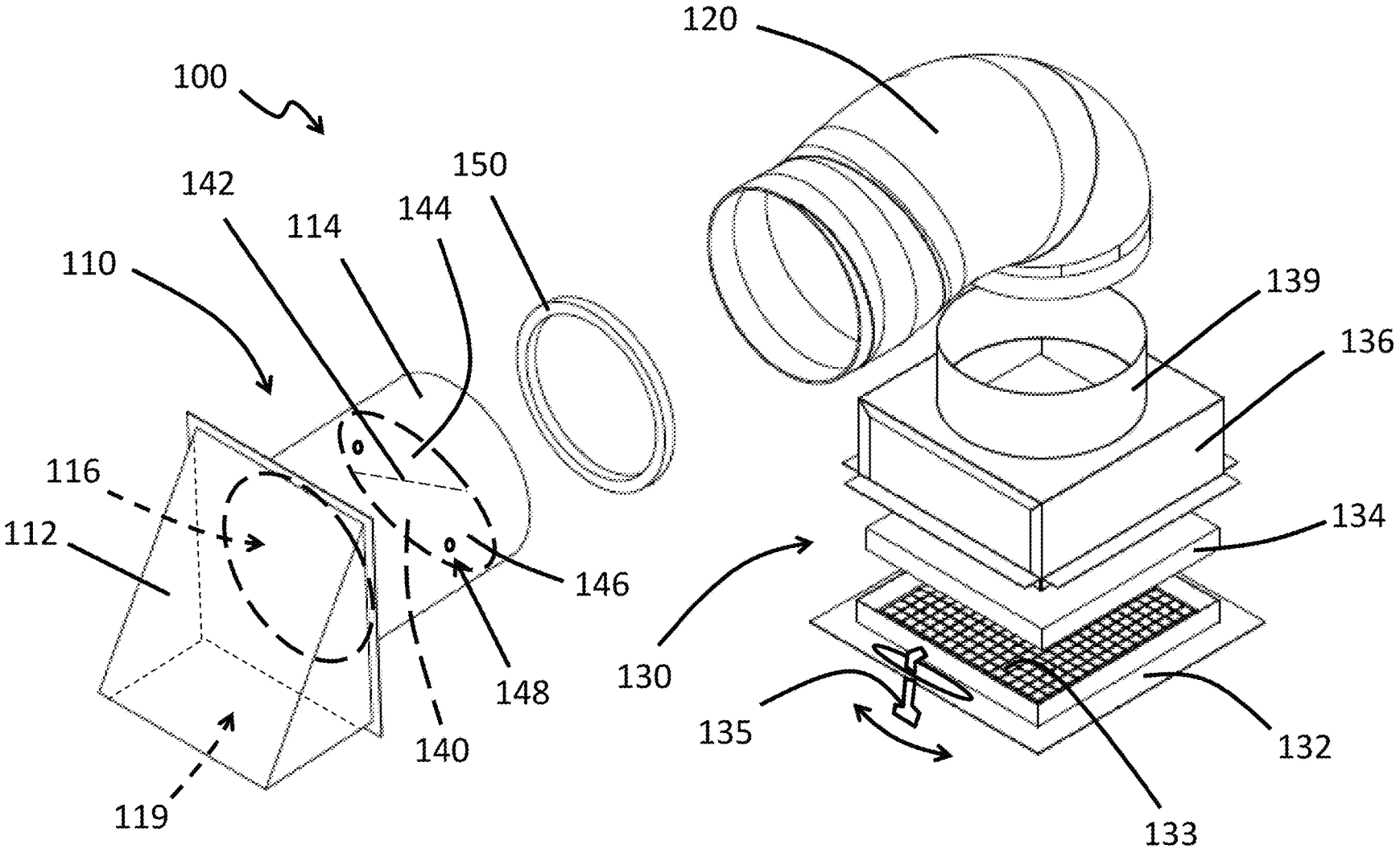
FIG. 2 is an assembly view of an air intake assembly according to some aspects of the present disclosure.

FIG. 2 shows an assembly view of an embodiment of the air intake assembly 100. As shown in FIG. 2, the exterior interface assembly 110 can have an exterior portion or face portion 112 and an interior portion or conduit 114. In use, the face portion 112 can be disposed at or on the exterior surface of the building structure 10. The face portion 112 can include features that inhibit or prevent water and outside debris from accessing the interior portion 114. In the illustrated embodiment, the face portion 112 is adapted to slope away from the exterior wall in the direction of the ground to form an awning-like structure that prevents or inhibits water (e.g., rain) or debris from entering the conduit 114 of the exterior interface assembly 110 (e.g., through a communicating opening 116 that provides a flow path between the face portion 112 and the conduit 114).

The conduit 114 can be sized to extend through at least a portion of the exterior wall of the building structure 10 and toward the living space 12. The conduit 114 can be adapted to connect with the duct 120. The conduit 114 and the duct 120 can be adapted to couple with one another to establish a flow path between the exterior interface assembly 110 and the duct 120. In some embodiments, the duct 120 can be sized to receive at least a portion of the exterior interface assembly 110, such that the exterior interface assembly 110 is inserted into the duct 120 to couple the exterior interface assembly 110 to the duct 120. In some arrangements, the exterior interface assembly 110 can be sized to receive at least a portion of the duct 120, such that the duct 120 is inserted into the exterior interface assembly 110 to couple the exterior interface assembly 110 to the duct 120. In some arrangements, the duct 120 and the exterior interface assembly 110 are connected to one another end-to-end. In the illustrated embodiment of FIG. 2, the conduit 114 and the duct 120 each has a cross-sectional shape that is circular. In some embodiments, the interior portion 114 or the duct 120 can have a cross-sectional shape that is non-circular (e.g., rectangular, oval).

As shown in FIG. 2, the air-intake assembly 100 can include a gasket 150. The gasket 150 can help form a seal between the exterior interface assembly 110 and the duct 120 to minimize or prevent air from escaping the air assembly 100 at the junction of the exterior interface assembly 110 and the duct 120. The gasket 150 can be made of foam, silicone, or other suitable material. The gasket 150 can be disposed between the exterior interface assembly 110 and the duct 120. For example, the gasket 150 can have an outer diameter that is slightly less than an inner diameter of the duct 120, thereby allowing the gasket 150 to be inserted into the duct 120. The gasket 150 can have an inner diameter that is slightly larger than an outer diameter of the conduit 114 of the exterior interface assembly 110, thereby allowing the conduit 114 to fit within the central opening of the gasket 150. In this way, the gasket 150 can be disposed within the duct 120 and between the exterior interface assembly 110 and the duct 120. In some embodiments, the orientation can be reversed so that the gasket 150 is disposed within the conduit 114 and the duct 120 can be sized to fit within the central opening of the gasket 150. In some embodiments, the gasket 150 is fitted over an end-to-end seam between the exterior interface assembly 110 and the duct 120. In some arrangements, a portion of the gasket 150 can be adapted to receive a portion of the duct 120 while an opposite portion of the gasket 150 can be adapted to receive a portion of the exterior interface assembly 110. In the illustrated embodiment, the duct 120 is shown as a single, unitary structure. In some aspects, the duct 120 can include a plurality of portions that are joined together to form a flow path. For example, the duct 120 can include a first portion that is in fluidic communication with a second portion such that a flow path is provided that extends across the first and second portions.

With continued reference to FIG. 2, the air intake assembly 100 can include a damper 140 that regulates air flow through the air intake assembly 100. In the illustrated embodiment, the damper 140 is shown disposed within the conduit 114 of the exterior interface assembly 110. However, the damper 140 can be arranged differently to regulate air flow through the air intake assembly 100. In some embodiments, the damper 140 can be disposed within the duct 120, within the register 130, within the face portion 112, within the communicating opening 116, within an entry opening 119 of the exterior interface assembly 110, or at other positions along the flow path from the exterior interface assembly 110 to the register 130. The damper 140 can be a motorized damper that is moved between the open and closed configurations in response to a control signal received by the integrated thermostat 300. In some embodiments, the damper 140 is not motorized and can move between the open and closed configurations without receiving a control signal from the integrated thermostat 300. In some embodiments, the damper 140 can be a flap that moves in response to a pressure differential applied across the damper 140. In some aspects, the cracking pressure of the damper 140 can be adjusted to increase or decrease the amount the damper 140 opens in response to a negative static pressure in the living space 12. In some aspects, decreasing the cracking pressure of the damper 140 can increase the amount the damper 140 opens for a given pressure differential across the damper 140, thereby increasing the flow rate of fresh outside air through the damper 140 in response to the pressure differential across the damper 140. In some aspects, increasing the cracking pressure of the damper 140 can decrease the amount the damper 140 opens for a given pressure differential across the damper 140, thereby decreasing the flow rate of fresh outside air through the damper 140 in response to the pressure differential across the damper 140.

In the illustrated embodiment, the damper 140 is depicted as a hinged flap that is mounted within the conduit 114. As shown in FIG. 2, the damper 140 can include a hinge 142 that connects a first leaf 144 and a second leaf 146 of the damper 140. The first leaf 144 and the second leaf 146 can fold toward one another (e.g., each pivoting about the hinge 142 toward the register 130) when a negative pressure is applied across the air intake assembly 100 (e.g., when the air pressure at the exterior portion 112 is greater than the air pressure at the register 130). The damper 140 can be oriented in a plane that forms an angle with a plane that is transverse to the longitudinal axis of the conduit 114. Angling the damper 140 within the conduit 114 can allow the damper 140 to fall under gravitational force into a closed position when no pressure differential is applied across the air intake assembly 100. In some aspects, the damper 140 can include one or more counterweights 148 to assist in closure of the moveable leafs 144, 146, as described herein. The counterweights 148 can function as a damper tuning system that allows the cracking pressure of the damper 140 to be adjusted or modified, as described herein. In some aspects, the cracking pressure of the damper 140 can be adjusted by tilting the damper 140 toward or away from a vertical plane that aligns with the gravitational forces acting on the damper 140. For example, aligning the damper 140 with the gravitational direction can decrease the cracking pressure of the damper while tilting the damper 140 away from the gravitational direction can increase the cracking pressure of the damper 140 by increasing the moment arm of the moveable leafs 144, 146 or counterweights 148 relative to the hinge 142. In some aspects, the damper 140 can include a spring tensioner that can function as a damper tuning system, as described herein. In some aspects, the tilt of the damper 140 or the tension of the spring tensioner can be adjusted by the control dial 303 (FIG. 1).

The damper 140 can have a cracking pressure that is defined as the pressure differential across the damper 140 at which the first leaf 144 and the second leaf 146 move into the open configuration (e.g., fold toward one another in a direction away from the communicating opening 116). The hinge 142 can have a cracking pressure of about: 0.03 mmHg, 0.06 mmHg, 0.1 mmHg, 0.2 mmHg, 0.4 mmHg, 0.8 mmHg, 1.0 mmHg, 1.5 mmHg, 2.0 mmHg, 3.0 mmHg, 6.0 mmHg; or a pressure between any of these listed values. The hinge 142 can be adjustable, allowing the cracking pressure to be set to a desired value. For example, the damper 140 can include one or more counterweights 148 that allow the cracking pressure to be adjusted, as described herein. In the illustrated embodiment, the cracking pressure of the damper 140 can be increased by moving the counterweight 148 away from the hinge 142 (e.g., increasing the radius of the counterweight 148 from the hinge 142). In some aspects, the cracking pressure can be adjusted by changing the tilt or angle of the counterweight 148 relative to the gravitational direction, as described herein. In some embodiments, the hinge 142 can include a spring tensioner that allows the cracking pressure of the damper 140 to be modified (e.g., increased or decreased) by adjusting the tension of the spring tensioner, as described herein. In some aspects, the cracking pressure of a first damper 140 can be set to be higher than the cracking pressure of a second damper 140 by installing in the first damper 140 a spring that has a higher spring constant (e.g., more stiff) compared to that of a spring that is installed in the second damper 140. In some aspects, the spring constant of a first damper 140 can exceed the spring constant of a second damper 140 by about: 0.03 mmHg, 0.06 mmHg, 0.1 mmHg, 0.2 mmHg, 0.4 mmHg, 0.8 mmHg, 1.0 mmHg, 1.5 mmHg, 2.0 mmHg, 3.0 mmHg, 6.0 mmHg; or a pressure between any of these listed values.

As discussed herein, the fresh-air cooling system 101 can be adapted to allow the cracking pressure of the air intake assembly 100 to be adjusted. In some aspects, the cracking pressure of the air intake assembly 100 can be tuned to adjust the distribution of air flow through the building structure 10. For example, the cracking pressure of a first air intake assembly 100 can be adjusted to be below (e.g., more negative) a cracking pressure of a second air intake assembly 100 in order to preferentially drive air flow through the second air intake assembly 100 when the cooling system 101 is operating. In some embodiments, the integrated thermostat 300 can control the opening and closing of the air intake assemblies 100 to promote air flow through a first air take assembly 100 while inhibiting air flow through a second air intake assembly 100.

The cracking pressure of an air intake assembly 100 can be adjusted to compensate for differences in the negative static pressure that is created within the living space 12 when the cooling system 101 is operating. For example, the fresh-air cooling system 101 can create a first negative static pressure in a first room of the building structure 10 and a second negative static pressure in a second room, with the first and second negative static pressures being different from one another. Differences in the negative static pressure within the building structure 10 can arise from the interior design of the building structure 10 or from the opening or closing of an interior door or an exterior door ow window. The fresh-air cooling system 101 can include a first air intake assembly 100 that conveys outside air to the first room and a second air intake assembly 100 that conveys outside air to the second room. The air intake assembly 100 can allow the cracking pressure of the first and second air intake assemblies 100 to be adjusted to more evenly distribute air flow through the building structure 10. For example, the cooling system 101 can create a negative static pressure in the first room that is 0.1 mmHg stronger (e.g., more negative) than the negative pressure in the second room. The cracking pressure of the first air intake assembly 100 can be increased (e.g., with the counterweights 148, or tilting of the damper 140, or a spring tensioner) so that the first and second air intakes 100 open more or less simultaneously when the cooling system 101 is operating to draw outside air into the living space 12. In some embodiments, the cooling system 101 can have a first air intake assembly 100 that has a first cracking pressure and a second air intake assembly 100 with a second cracking pressure, with the difference between the first cracking pressure and the second cracking pressure being about: 0.01 mmHg, 0.02 mmHg, 0.05 mmHg, 0.1 mmHg, 0.2 mmHg, 0.5 mmHg, 1 mmHg, 2 mmHg, 6 mmHg, or a value between these listed pressures. In some aspects, the air flow rate through the air intake assembly 100 can be adjusted upstream or downstream of the damper 140, as described herein.

With continued reference to FIG. 2, the register 130 can have a grill 132, a filter 134, and an antechamber 136. The antechamber 136 can include a cuff 139 configured to couple with the duct 120 to establish a flow path from the duct 120 to the register 130. The grill 132 can be adapted to be installed in an interior wall or ceiling of a living space 12. The register 130 can be adapted to allow the impedance of air flow through the register 130 to be adjusted or modified. For example, the grill 132 can include a plurality of movable slats 133 that can be pivoted by a control arm 135 to open or close the moveable slats 133. The moveable slats 133 can be moved to an open configuration (e.g., low impedance of air flow through the register 130) to increase air flow through the grill 132. The moveable slats 133 can be moved to a closed configuration (e.g., high impedance of air flow through the register 130) to decrease air flow through the grill 132. In some aspects, the moveable slats 133 can be moved to a partially-opened configuration that provides a reduced airflow rate for a given negative static pressure applied across the damper 140. In this way, the register 130 can be adapted to increase or decrease air flow through the air intake assembly 100. The antechamber 136 can connect to the duct 120 to the grill 132 to establish a flow path between the duct 120 and the grill 132 so that outside air can pass through the grill 132 to reach the living space 12. The antechamber 136 can house a filter 134. The filter 134 can be adapted to remove pollutants (e.g., pollen, mold, dust) from the outside air before the outside air enters the living space 12. In some aspects, the filter 134 can be selected to adjust the air flow rate through the air intake assembly 100. For example, a high-flow rate filter 134 can impede flow through the register 130 less than a low-flow rate filter 134, and the high-flow rate filter 134 can be installed in the register 130 to increase air flow through the air intake assembly 100.

Figure 3B:
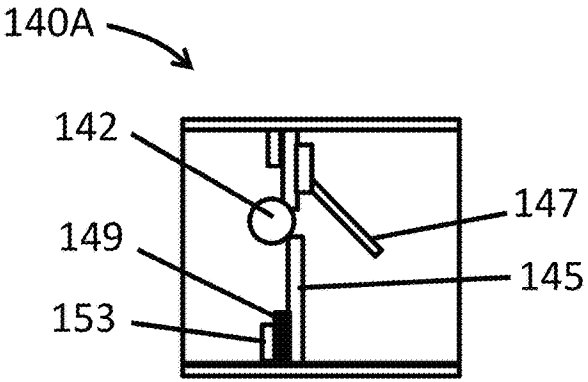
FIG. 3B is a side cross-sectional view of the damper of FIG. 3A.
Figure 3D:
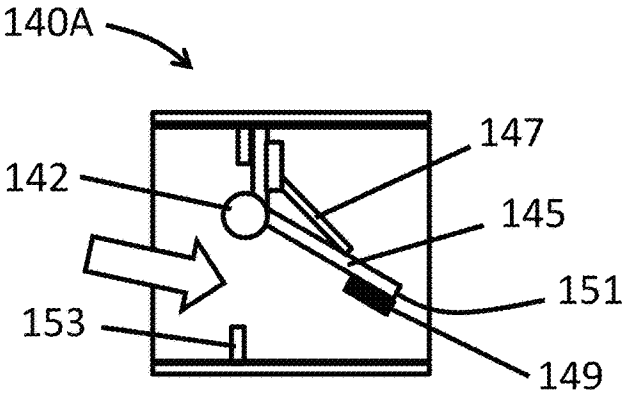
FIG. 3D is a side cross-sectional view of the damper of FIG. 3C.
Figure 3A:
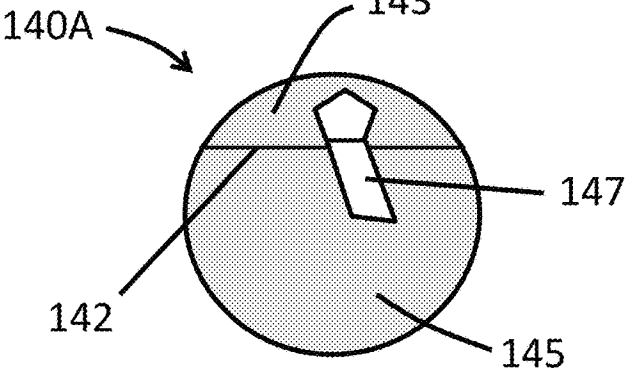
FIG. 3A is a partial front view of a closed damper according to some aspects of the present disclosure.
Figure 3C:
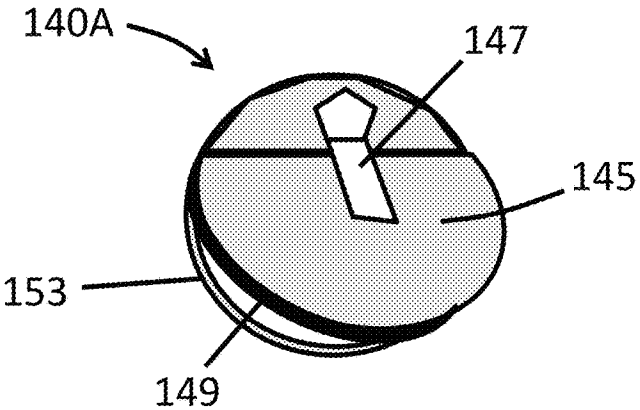
FIG. 3C is a partial front view of an open damper according to some aspects of the present disclosure.

FIGS. 3A-3D illustrate an embodiment of a damper 140A similar to the damper 140 except as described differently below. The damper 140A can have a fixed flap 143 and a moveable flap 145 that are joined by a hinge 142. The damper 140A can have a stop member 147 that limits the extent to which the moveable flap 145 can pivot about the hinge 142. The moveable flap 145 can include a sealer 149 that forms a seal with a flange 151 when the damper 140A is in the closed configuration (FIG. 3B). The sealer 149 can be disposed on the upstream face of the moveable flap 145, as shown. In some aspects, the sealer 149 can be disposed on a peripheral edge surface 151 of the moveable flap 145. In some arrangements, the damper 140A can include the flange 153. In some arrangements, the flange 153 can be disposed on a surrounding surface of a housing or conduit into which the damper 140A is installed. In some aspects, the damper 140A can form a seal without requiring the presence of the flange 153, for example as indicated in the damper 140 shown in FIG. 2. The open arrow depicted in FIG. 3D illustrates air flow through the damper 140A when the moveable flap 145 is in the open configuration.

Figure 4B:
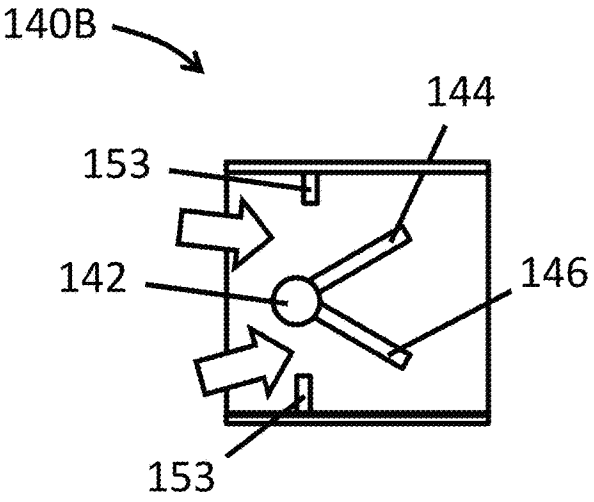
FIG. 4B is a side cross-sectional view of the damper of FIG. 4A.
Figure 4A:
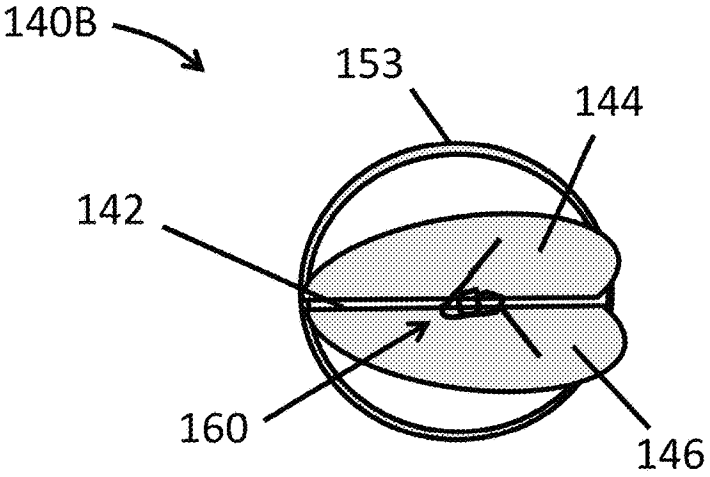
FIG. 4A is a partial front view of an open damper according to some aspects of the present disclosure.
Figure 4C:
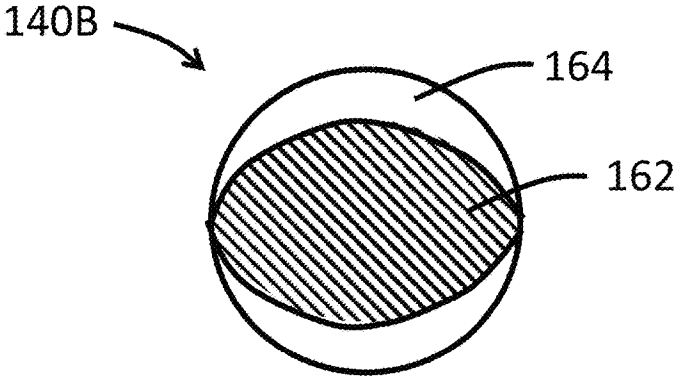
FIG. 4C is a schematic front view of the open damper of FIG. 4A, illustrating the portions of the flow path that are blocked by the open damper.

FIGS. 4A-4C illustrate an embodiment of a damper 140B similar to the damper 140A except as described differently below. The damper 140B can include a pair of movable leafs 144, 146 that are joined by a hinge 142. The damper 140B can include a biasing element 160. The biasing element 160 can bias the moveable leafs 144, 146 into a closed configuration. In the illustrated embodiment, the biasing element 160 is a spring that is configured to push each of the moveable leafs 144, 146 toward the upstream flange 153 of the damper 140B. In some aspects, the damper 140B does not include a flange 153 and the biasing element 160 pushes the moveable leafs 144, 146 against the inner surface of the housing or conduit (e.g., duct 120) into which the damper 140B is installed. The biasing element 160 can be differently arranged, as described herein. For example, the biasing element 160 can be an elastic element that is installed over the upstream surface of the hinge 142 (see, e.g., FIG. 6) and resists tension such that the biasing element 160 pulls the moveable leafs 144, 146 into the closed configuration.

FIG. 4B depicts air flow (open arrow) through the damper 140B when the moveable leafs 144, 146 are in the open configuration. FIG. 4C is a schematic illustration of an end view of the damper 140B showing the portions of the damper 140B that are blocked (crosshatching) or open (no crosshatching) to air flow when the damper 140B is in the open configuration. In the illustrated embodiment, the blocked portions 162 are centrally located while the open portions 164 are distributed at the periphery of the damper 140B. Distributing air flow to the periphery of the damper 140B can increase flow resistance through the damper 140B due to the increase drag forces on the air passing through the damper 140B. In some aspects, the airflow resistance of the damper 140B can be selected to tune or adjust the rate of air flow through portions of the building structure 10, as described herein.

Figure 5B:
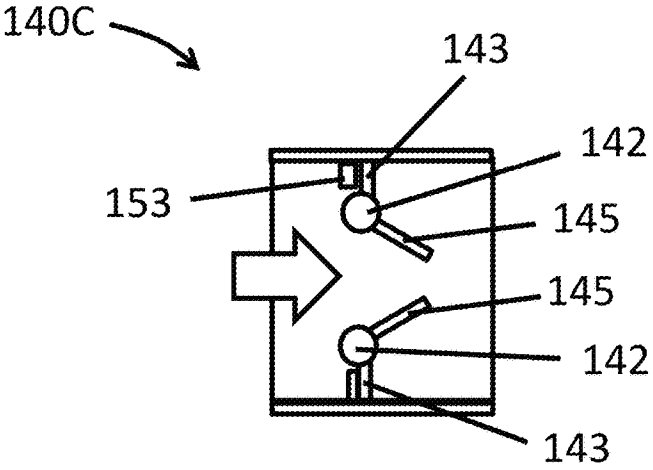
FIG. 5B is a side cross-sectional view of the damper of FIG. 5A.
Figure 5A:
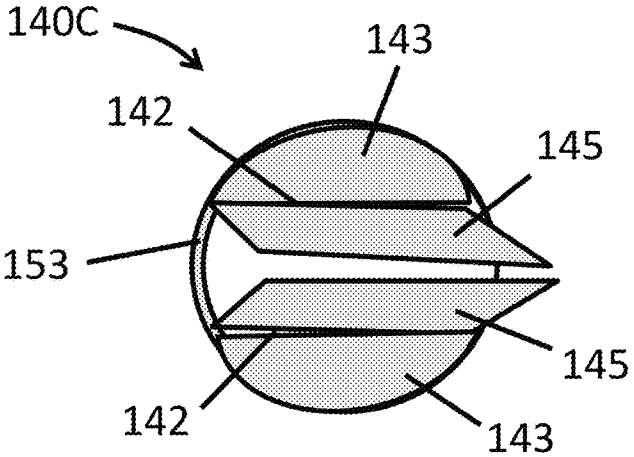
FIG. 5A is a partial side and front view of an open damper according to some aspects of the present disclosure.
Figure 5C:
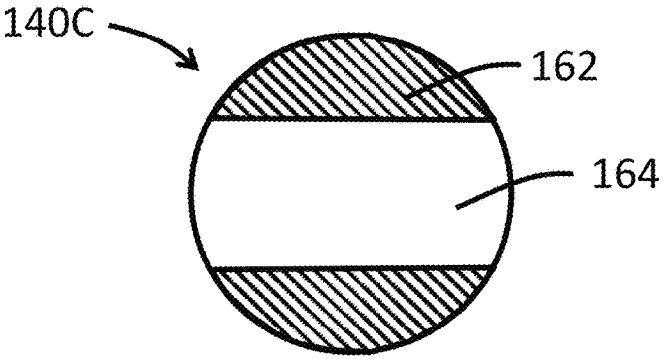
FIG. 5C is a schematic front view of the open damper of FIG. 5A, illustrating the portions of the flow path that are blocked by the open damper.

FIGS. 5A-5C illustrate an embodiment of a damper 140C similar to the damper 140B except as described differently below. The damper 140C can include a pair of fixed flaps 143 that are each joined to a moveable flap 145 by a hinge 142. In the illustrated embodiment, the fixed flap 143 is disposed toward the periphery of the damper 140C while the moveable flap 145 is more centrally located on the damper 140C. In some arrangements, the orientation can be reversed such that the moveable flap 145 is disposed toward the periphery of the damper 140C while the fixed flap 143 is more centrally located on the damper 140C. FIG. 5C is a schematic illustration of an end view of the damper 140C, showing the portions of the damper 140C that are blocked (crosshatching) or open (no crosshatching) to air flow when the damper 140C is in a fully-opened configuration. In the illustrated embodiment, the open portions 164 are centrally located while the blocked portions 162 are distributed at the periphery of the damper 140C. Distributing air flow to the central portion of the damper 140C can decrease flow resistance through the damper 140C due to the lower drag forces (e.g., shear forces) on the air passing through the damper 140C.

Figure 6:
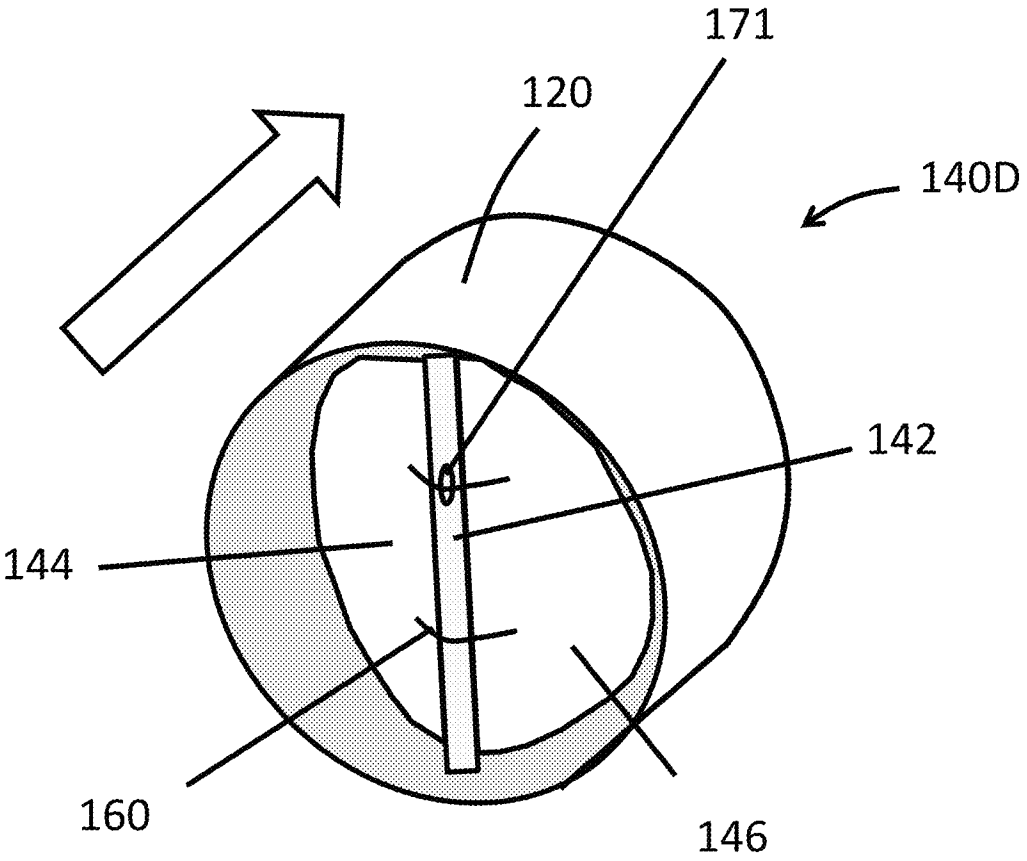
FIG. 6 is a partial end view of an open damper according to some aspects of the present disclosure.

FIG. 6 illustrates an embodiment of a damper 140D similar to the damper 140C except as described differently below. The open arrow indicates the direction of air flow through the damper 140C when the fresh-air cooling system 101 operates to create a negative static pressure in the living space 12 to draw outside air through the damper 140C. The damper 140C is shown installed within the duct 120 of the fresh-air cooling system 101. In some aspects, the damper 140C can be installed in the exterior interface assembly 110 or the register 130, as described herein. As shown, the damper 140D can include a biasing element 160 that is configured as a tension spring stretched over the hinge 142 and attached to the upstream surfaces of the moveable flaps 144, 146. A spring tensioner 171 can be extended from the hinge 142 to increase the distension of the biasing element 160 and thereby increase the cracking pressure of the damper 140D. The spring tensioner 171 can be drawn into the hinge 142 to decrease the distension of the biasing element 160 and thereby decrease the cracking pressure of the damper 140D. In some aspects, the extension of the spring tensioner 171 from the hinge 142 can be controlled by the control dial 303 or integrated thermostat 300 (FIG. 1). The moveable flaps 144, 146 can move into the open configuration by folding toward one another such that the downstream surfaces of the moveable flaps 144, 146 approach one another. As described herein, the moveable flaps 144, 146 can move into the open configuration by the fan 200 creating a negative static pressure differential across the flow damper 140D. In some embodiments, the moveable flaps 144, 146 can be moved into the open configuration by a motor 170 (FIG. 7).

Figure 7:
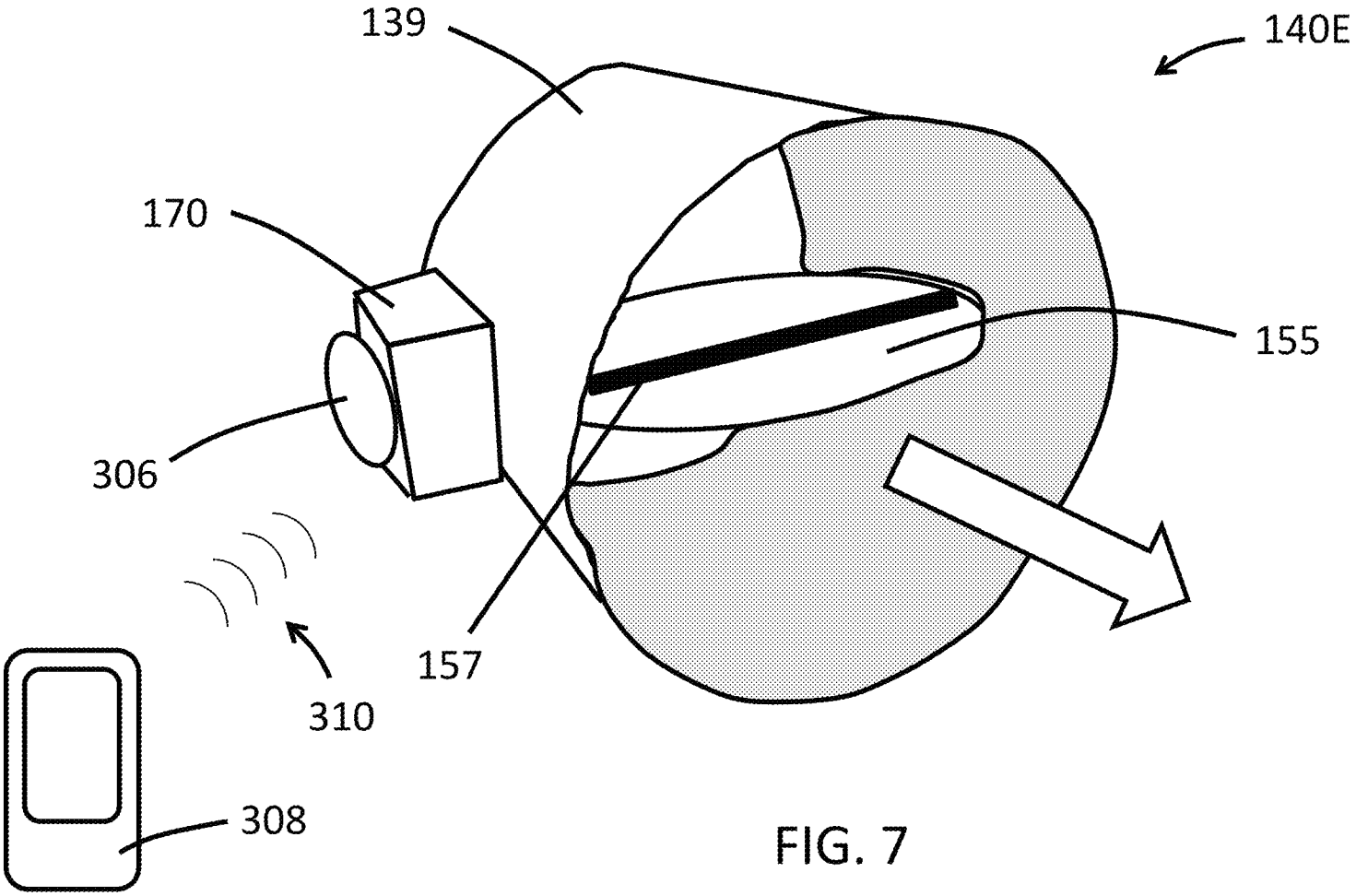
FIG. 7 is a partial end view of a motorized damper according to some aspects of the present disclosure.

FIG. 7 illustrates an embodiment of a damper 140E similar to the damper 140D except as described differently below. The damper 140E is shown installed within the cuff 139 of the antechamber 136 (FIG. 2). In some aspects, the damper 140C can be installed in the exterior interface assembly 110 or the duct 120, as described herein. The damper 140E can include a pivoting flap 155 that is coupled to an axle 157. The damper 140E can include a motor 170 configured to rotate the axle 157 and move the pivoting flap 155 between an open configuration and a closed configuration. In the illustrated embodiment, the pivoting flap 155 is shown in an open configuration that allows airflow (open arrow) to pass through the damper 140E. The motor 170 can be controlled by the control dial 303 or the integrated thermostat 300 (FIG. 1), as described herein. In some aspects, the motor 170 can be controlled by a mobile device 308 (e.g., smart phone, tablet). The integrated thermostat 300 or the mobile device 308 can send a control signal 310 to the motor 170 to instruct the motor 170 to adjust the position of the pivoting flap 155. In some embodiments, the pivoting flap 155 can be a plurality of pivoting flaps 155 rather than the single pivoting flap 155 shown in FIG. 7.

Figure 8:
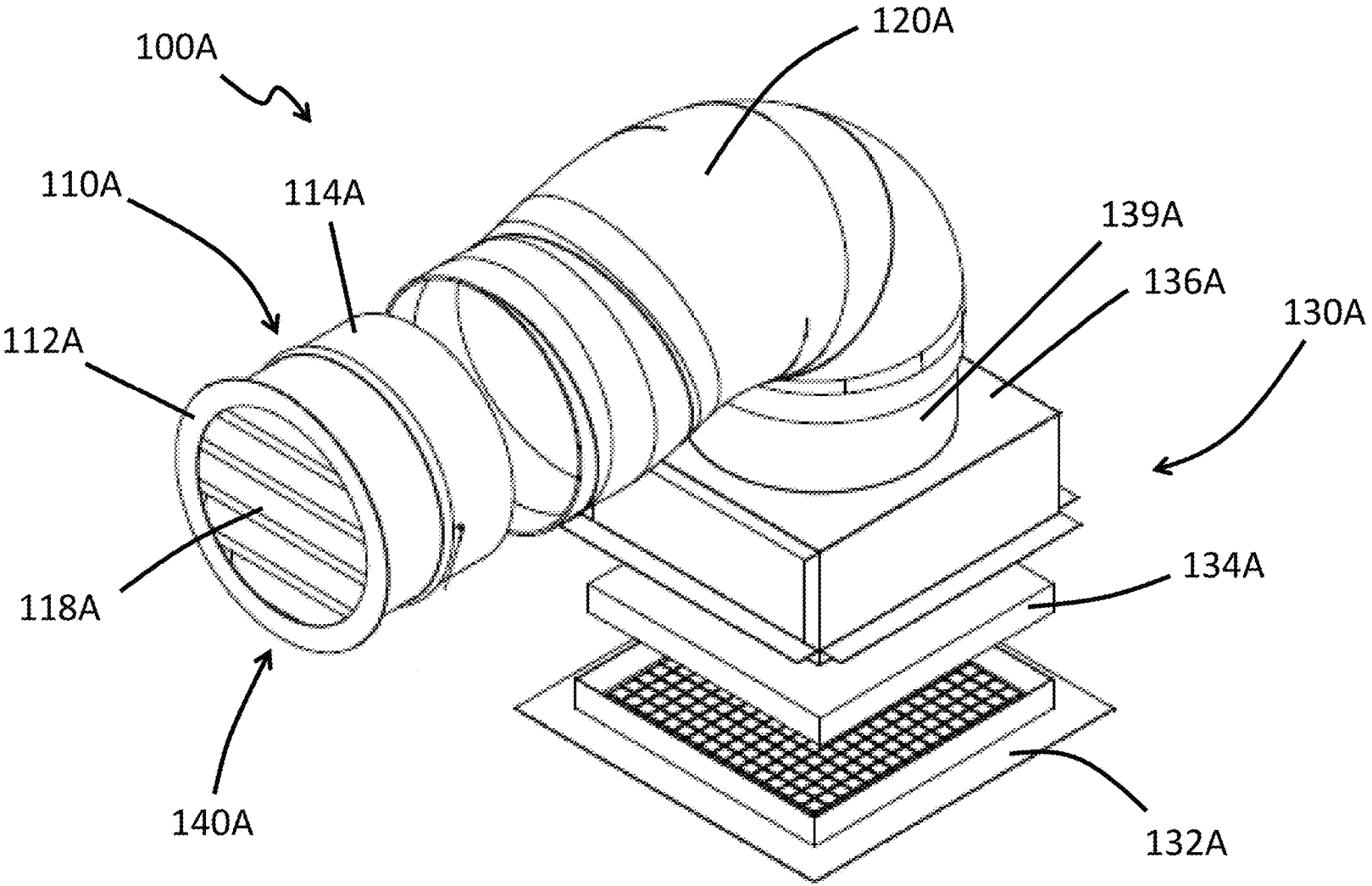
FIG. 8 is an assembly view of an embodiment of an air intake assembly according to some aspects of the present disclosure.

FIG. 8 illustrates another embodiment of an air intake assembly 100A similar to the air intake assembly 100 except as described differently below. The features of the air intake assembly 100A can be combined or included with the air intake assembly 100 or any other embodiment discussed herein. The face portion 112A of the exterior interface assembly 110 can be adapted to sit flush on an exterior surface of the building structure 10 when the air intake assembly 100A is installed in the building structure 10. In this way, the appearance of the air intake assembly 100A can be made more discreet. As shown in FIG. 8, the face portion 112A can include a plurality of slats 118A. In some variants, the slats 118 can be moveable between an open configuration that allows outside air to enter the air intake assembly 100A and a closed configuration that blocks outside air from entering the air intake assembly 100A. In this way, the plurality of movable slats 118A can function as a damper 140. In some embodiments, the air intake assembly 100A can include a damper 140 other than the plurality of movable slats 118A. For example, the air intake assembly 100A can include moveable slats 118A disposed on the face portion 112A of the exterior interface assembly 110A and a damper 140 disposed within the conduit 114A of the exterior interface assembly 110A or at a location other than the conduit 114A, as described herein. In some embodiments, the slats 118A are not movable and can be fixed relative to the face portion 112A. In some aspects, the slats 118A can slope downward as shown in FIG. 8 in order to block or inhibit debris and water from entering the air intake assembly 100A, as discussed herein.

Figure 9:
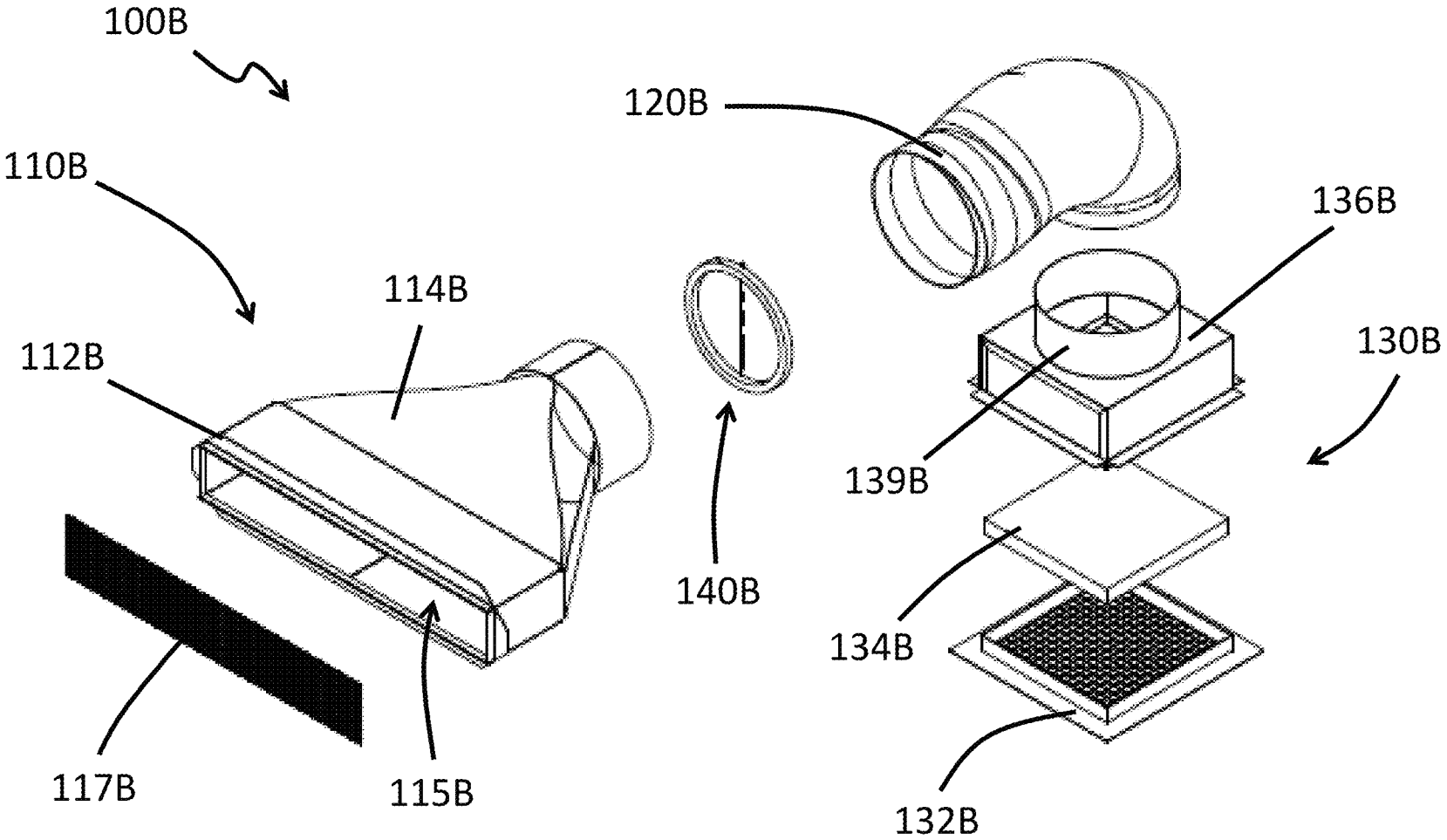
FIG. 9 is an assembly view of an embodiment of an air intake assembly according to some aspects of the present disclosure.

FIG. 9 illustrates another embodiment of an air intake assembly 100B similar to the air intake assembly 100A except as described differently below. The features of the air intake assembly 100B can be combined or included with the air intake assembly 100A or any other embodiment discussed herein. As shown in FIG. 9, the face portion 112B can be shaped to have an elongate or rectangular inlet opening 115B. The inlet opening 115B can be flush with an exterior surface of the building structure 10 when the air intake assembly 100B is installed in the building structure 10. The elongate shape of the inlet opening 115B can make the appearance of the air intake assembly 100B more discreet when viewed from the outside environment. In some aspects, the elongate inlet opening 115B can have a length dimension that is greater than two times a width dimension of the opening 115B. The inlet opening 115B can be shaped to prevent or inhibit animals from entering the air intake assembly 100B. The air intake assembly 100B can include a screen 117B that fits into the inlet opening 115B. The screen 117B can be adapted to block or inhibit water or debris from entering the air intake assembly 100B, as discussed herein.

Figure 10:
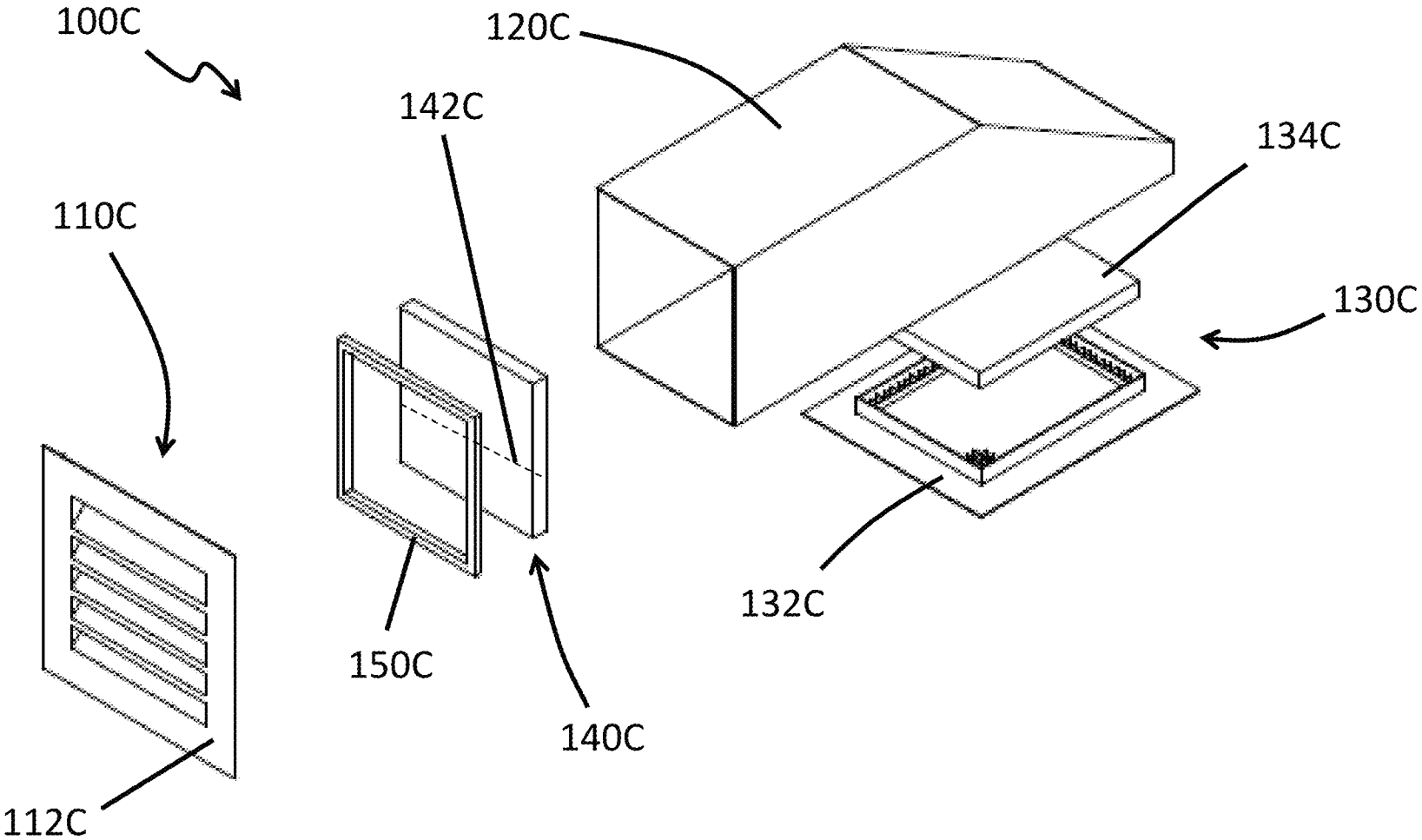
FIG. 10 is an assembly view of an embodiment of an air intake assembly according to some aspects of the present disclosure.

FIG. 10 illustrates another embodiment of an air intake assembly 100C similar to the air intake assembly 100B except as described differently below. The features of the air intake assembly 100C can be combined or included with the air intake assembly 100B or any other embodiment discussed herein. As shown in FIG. 10, the duct 120C of the air intake assembly 100C can have a transverse cross-sectional shape that is non-circular. In the illustrated embodiment, the duct 120C has a square transverse cross-sectional shape. The duct 120C can be made of sheet metal and can be more rigid compared to an accordion-style, flexible duct 120 (FIG. 2). The air intake assembly 100C can include a gasket 150C disposed between the exterior interface assembly 110C and the damper 140C. The damper 140C can include a hinge 142C, as discussed herein.

The air intake assembly 100 can allow the operation of a fresh-air cooling system 101 to be controlled remotely without a user being present in the building structure 10. As discussed herein, the integrated thermostat 300 can include an internal temperature sensor 302 (FIG. 1) disposed within the building structure 10 and an external temperature sensor 304 disposed on the exterior of the building structure. The integrated thermostat 300 can monitor the temperature sensors 302, 304 to determine when the conditions are favorable for cooling the building structure 10 with the fresh-air cooling system 100. When favorable conditions are determined, the air intake assembly 100 can automatically open the air intake assembly 100 and activate the high-capacity fan 200 in order to begin cooling the building structure 10, as discussed herein. In some arrangements, the air intake assembly 100 can open by activating the high-capacity fan 200 to create a negative static pressure in the living space 12, as described herein. In some embodiments, the fresh-air cooling system 100 can use a motor 170 (FIG. 7) to open and close the damper 140, as described herein.

The air intake assembly 100 can include a wireless transmitter and/or a wireless receiver 306 (FIG. 7) that allows air intake assembly 100 to communicate with a mobile device 308 (e.g., smart phone, tablet, etc.). The mobile device 308 can send a control signal 310 to the air intake assembly 100 to check or change the operation of the air intake assembly 100. For example, a user can have a mobile device 308 that includes a software application (app) that allows the user to turn on or turn off the cooling system 101. The app can inform the user of the position of the damper 140 of the air intake assemblies 100 of the cooling system 101. In some embodiments, the app can receive information from the internet (e.g., a website providing the current local outside temperature). The cooling system 101 can determine favorable cooling conditions based on information received from the internet such that the cooling system 101 need not have an external temperature sensor 304 (FIG. 1) in order to determine favorable conditions for activating the cooling system 101.

All of the features disclosed in this specification (including any accompanying exhibits, claims, abstract and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract and drawings), or to any novel one, or any novel combination, of the steps of any method or process so disclosed.

Those skilled in the art will appreciate that in some embodiments, the actual steps taken in the processes illustrated or disclosed may differ from those shown in the figures. Depending on the embodiment, certain of the steps described above may be removed, others may be added. For example, the actual steps or order of steps taken in the disclosed processes may differ from those shown in the figure. Depending on the embodiment, certain of the steps described above may be removed, others may be added. For instance, the various components illustrated in the figures may be implemented as software or firmware on a processor, controller, ASIC, FPGA, or dedicated hardware. Hardware components, such as processors, ASICs, FPGAs, and the like, can include logic circuitry. Furthermore, the features and attributes of the specific embodiments disclosed above may be combined in different ways to form additional embodiments, all of which fall within the scope of the present disclosure.

Conditional language, such as "can," "could," "might," or "may," unless specifically stated otherwise, or otherwise understood within the context as used, is generally intended to convey that certain embodiments include, while other embodiments do not include, certain features, elements, or steps. Thus, such conditional language is not generally intended to imply that features, elements, or steps are in any way required for one or more embodiments or that one or more embodiments necessarily include logic for deciding, with or without user input or prompting, whether these features, elements, or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Likewise the term "and/or" in reference to a list of two or more items, covers all of the following interpretations of the word: any one of the items in the list, all of the items in the list, and any combination of the items in the list. Further, the term "each," as used herein, in addition to having its ordinary meaning, can mean any subset of a set of elements to which the term "each" is applied. Additionally, the words "herein," "above," "below," and words of similar import, when used in this application, refer to this application as a whole and not to any particular portions of this application.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

Various modifications to the implementations described in this disclosure may be readily apparent to those skilled in the art, and the generic principles defined herein may be applied to other implementations without departing from the spirit or scope of this disclosure. Thus, the disclosure is not intended to be limited to the implementations shown herein, but is to be accorded the widest scope consistent with the principles and features disclosed herein. Certain embodiments of the disclosure are encompassed in the claim set listed below or presented in the future.

What is claimed is:

1. A method for creating airflow in a building structure having an attic and a living space, the method comprising:

energizing a motorized fan disposed in the attic to pull air from the living space into the attic to create in the living space a static pressure less than an ambient air pressure of air outside of the building structure;

moving a flap of a damper disposed within a conduit of an exterior interface assembly from a closed configuration to an open configuration in response to a cracking pressure being applied across the damper, the exterior interface assembly attached to an exterior wall of the building structure, the damper comprising a biasing element that biases the flap toward the closed configuration in which the flap blocks an internal cross-sectional area of the conduit such that an airflow through the conduit is prevented, the biasing element allowing the flap to move to the open configuration in response the static pressure exceeding the cracking pressure of the damper, wherein in the open configuration at least a portion of the internal cross-sectional area of the conduit is uncovered by the flap to allow the airflow through the conduit; and directing the airflow from the conduit through a duct to a register, the register attached to an interior wall or ceiling of the living space to direct the airflow into the living space from the register.

2. The method of claim 1, further comprising changing the cracking pressure of the damper from a first value to a second value that is different from the first value.

3. The method of claim 2, further comprising moving a counterweight to change the cracking pressure.

4. The method of claim 2, further comprising adjusting a spring tension of the biasing element to change the cracking pressure.

5. The method of claim 1, wherein directing the airflow through the duct comprises directing the airflow through a first duct portion and a second duct portion.

6. The method of claim 1, wherein in the closed configuration, the flap blocks the internal cross-sectional area of the conduit by forming a seal against a gasket disposed in the conduit.

7. The method of claim 1, further comprising moving a second flap of a second damper disposed within a second conduit of a second exterior interface assembly from a closed configuration to an open configuration in response to a second cracking pressure being applied across the second damper.

8. The method of claim 7, wherein the second cracking pressure of the second damper is different from the cracking pressure of the damper.

9. The method of claim 7, wherein the second cracking pressure of the second damper is the same as the cracking pressure of the damper.

10. The method of claim 7, further comprising directing the airflow from the second conduit through the duct to the register.

11. The method of claim 1, further comprising directing the airflow from the conduit through a second duct to a second register, the second register directing the airflow into the building structure from the second register.

12. The method of claim 1, wherein the exterior wall of the building structure is vertical.

13. A method for creating airflow in a building structure having an attic and a living space, the method comprising:

energizing a motorized fan disposed in the attic to pull air from the living space into the attic to create in the living space a static pressure less than an ambient air pressure of air outside of the building structure;

moving a flap of a damper from a closed configuration to an open configuration, the damper connected to an exterior interface assembly, a duct, or an antechamber of a register, the exterior interface assembly attached to an exterior wall of the building structure, the register attached to an interior wall or ceiling of the living space, wherein in the closed configuration, the flap inhibits an airflow through the exterior interface assembly or the antechamber, and in the open configuration, the flap allows the airflow through the exterior interface assembly or the antechamber; and directing the airflow from the exterior interface assembly through the duct to the register and into the living space from the register, wherein the damper further comprises a biasing element, wherein the biasing element is configured to bias the flap toward the closed configuration, wherein the biasing element is further configured to allow the flap to move to the open configuration in response to a cracking pressure being applied across the damper, and wherein the static pressure less than the ambient air pressure created by the motorized fan exceeds the cracking pressure of the damper such that the flap moves to the open configuration to allow the air outside of the building structure to flow into the living space.

14. The method of claim 13, further comprising changing the cracking pressure of the damper by adjusting a spring tension of a spring of the damper, the biasing element comprising the spring.

15. The method of claim 13, further comprising changing the cracking pressure of the damper by moving a counterweight of the damper, the biasing element comprising the counterweight.

16. The method of claim 13, wherein the damper is attached to a conduit of the exterior interface assembly.

17. The method of claim 13, wherein the damper is attached to a cuff of the antechamber.

18. The method of claim 13, wherein the exterior wall of the building structure is vertical.

19. A method of flowing air in a building structure having an attic and a living space, the method comprising:

energizing a motorized fan disposed in the attic to pull air from the living space into the attic to create in the living space a static pressure less than an ambient air pressure of air outside of the building structure;

moving a first damper disposed inside a first air intake assembly from a closed configuration to an open configuration in response to the static pressure exceeding a first cracking pressure of the first damper, wherein the open configuration of the first damper allows the air outside of the building structure to flow through the first air intake assembly to reach the living space; and moving a second damper disposed inside a second air intake assembly from a closed configuration to an open configuration in response to the static pressure exceeding a second cracking pressure of the second damper, wherein the open configuration of the second damper allows the air outside of the building structure to flow through the second air intake assembly to reach the living space, wherein the second cracking pressure is less than the first cracking pressure.

20. The method of claim 19, wherein the first cracking pressure is greater than the second cracking pressure by a value that is between 0.03 mmHg and 6 mmHg.

21. The method of claim 19, further comprising changing the first cracking pressure of the first damper.

22. The method of claim 19, wherein at least one of the first air intake assembly or the second air intake assembly is attached to a vertical exterior wall of the building structure.

23. The method of claim 19, wherein the first damper further comprises a biasing element, wherein the biasing element is configured to bias the first damper toward the closed configuration, wherein the biasing element is further configured to allow the first damper to move to the open configuration in response to the first cracking pressure being applied across the first damper, and wherein the static pressure less than the ambient air pressure created by the motorized fan exceeds the first cracking pressure of the first damper such that the first damper moves to the open configuration to allow the air outside of the building structure to flow into the living space.

24. The method of claim 23, further comprising changing the first cracking pressure of the first damper by adjusting a spring tension of a spring of the first damper, the biasing element comprising the spring.

25. The method of claim 23, wherein further comprising changing the first cracking pressure of the first damper by moving a counterweight of the first damper, the biasing element comprising the counterweight.

26. The method of claim 19, wherein the second damper further comprises a biasing element, wherein the biasing element is configured to bias the second damper toward the closed configuration, wherein the biasing element is further configured to allow the second damper to move to the open configuration in response to the second cracking pressure being applied across the second damper, and wherein the static pressure less than the ambient air pressure created by the motorized fan exceeds the second cracking pressure of the second damper such that the second damper moves to the open configuration to allow the air outside of the building structure to flow into the living space.

27. The method of claim 26, further comprising changing the second cracking pressure of the second damper by adjusting a spring tension of a spring of the second damper, the biasing element comprising the spring.

28. The method of claim 26, wherein further comprising changing the second cracking pressure of the second damper by moving a counterweight of the second damper, the biasing element comprising the counterweight.

* * * * *